US006805610B2

(12) United States Patent
Luk

(10) Patent No.: US 6,805,610 B2
(45) Date of Patent: Oct. 19, 2004

(54) BRASSIERE

(75) Inventor: Theone Luk, Kwai Chung (HK)

(73) Assignee: Regina Miracle International Limited (HK)

( * ) Notice: Subject to any disclaimer, the term of this patent is extended or adjusted under 35 U.S.C. 154(b) by 0 days.

(21) Appl. No.: 10/349,514

(22) Filed: Jan. 21, 2003

(65) Prior Publication Data

US 2004/0142633 A1 Jul. 22, 2004

(51) Int. Cl.[7] ..... A41C 3/00
(52) U.S. Cl. ..... 450/54; 450/41
(58) Field of Search ..... 450/54–57, 39, 450/90, 92, 93, 41, 45–53; 264/257, 258, 291, 292, 294, 320, 321, 145, 148, 153–155, 157, 160, 163; 156/245

(56) References Cited

U.S. PATENT DOCUMENTS

| | | | | | |
|---|---|---|---|---|---|
| 3,114,374 | A | * | 12/1963 | Chalfin et al. | 450/41 |
| 4,080,416 | A | * | 3/1978 | Howard | 264/258 |
| 4,235,240 | A | | 11/1980 | Cousins | 128/476 |
| 4,244,249 | A | * | 1/1981 | DiTullio | 83/139 |
| 4,250,137 | A | * | 2/1981 | Riedler | 264/554 |
| 5,769,688 | A | * | 6/1998 | Holliday | 450/57 |
| 5,820,443 | A | * | 10/1998 | Burr | 450/40 |
| 5,967,877 | A | | 10/1999 | Howard | 450/57 |
| 6,213,841 | B1 | | 4/2001 | Kuo | 450/55 |
| 6,257,951 | B1 | * | 7/2001 | DeMarco | 450/55 |
| 6,645,040 | B2 | * | 11/2003 | Rabinowicz et al. | 450/1 |
| 2002/0106970 | A1 | | 8/2002 | Falla | |

FOREIGN PATENT DOCUMENTS

| | | |
|---|---|---|
| FR | 2 820 001 | 8/2002 |
| JP | 2000226704 | 8/2000 |
| WO | WO 02/054894 | 7/2002 |

* cited by examiner

*Primary Examiner*—Gloria M. Hale
(74) *Attorney, Agent, or Firm*—Ostrolenk, Faber, Gerb & Soffen, LLP

(57) ABSTRACT

A brassiere comprising a bra core which includes two breast cups of a cup shape to each support a breast of a person. Each breast cup is engaged to a chest band wherein the chest band is able to extend about the chest of a person and has distal end fastening clips. A layer of fabric is adhered to each side of the bra core, the layer being of a continuous sheet, formed to the contour the bra core.

15 Claims, 5 Drawing Sheets

BRASSIERE

FIELD OF THE INVENTION

The present invention relates to brassieres and in particular to a brassiere which incorporates a seamless breast cup construction and wherein the entire brassiere includes a negligible amount of stitching joining various components of the brassiere together.

BACKGROUND TO THE INVENTION

Construction details of brassieres (hereinafter referred to as "bras") have been developed over many years. Construction details have evolved along with the introduction of new materials and new processes which can be utilised for the manufacturing of bras. As with most consumer products, manufacturers endeavour to reduce the cost of goods sold. A reduction in cost of goods sold can be brought about by the use of cheaper materials. For bra technology however, a significant saving in the cost of a bra can be achieved by eliminating the man-hours required to manufacture the bra. Many bras that are available on the market will include multiple panels of materials which need to be cut, and joined. Cutting can be automated, however when it comes to stitching the panels together, this will mostly be done by a person. The breast cup of a bra may consist of multiple panels which each need to be stitched together, the entire breast cup then needs to be stitched to the chest band and to the over the shoulder straps. Perimeter stitching or overlooking to ensure that the edges of the material of the bra do not fray also needs to be added to the bra. Such is also done by a person. It can hence be seen that in order to manufacture a bra, the labour component of the overall cost can be relatively high.

Accordingly it is an object of the present invention to provide a bra which reduces the amount of stitching that is required compared to the majority of bras available on the market. It is also an object of the present invention to provide a seamless breast cup construction which will at least provide the public with a useful choice.

It is also an object of the present invention to provide a method of manufacturing a seamless breast cup construction and related bra incorporating such construction to reduce the labour content of manufacturing of the bra or to at least provide the public with a useful choice.

BRIEF DESCRIPTION OF THE INVENTION

According to the present invention, there is provided a brassiere having bra core which includes two breasts cups made from a flexible assembly of sheet materials and formed by molding to a cup shape to support the breasts of a person, each breast cup including at least a first sheet of molded foam material and a co extensive second sheet of foam material laminated directly together. Preferably, but optionally, the sandwiched intermediate the foam sheets are two underwire structures, one adjacent to each breast cup, the underwire structures being comprised of rigid elongated members and a surrounding casing. A chest band core having swaps sewn onto an inner gore region and extending in opposite directions from said inner gore regions is affixed to each breast cup by stitching. The chest band core extends about the chest of a person and includes mutually interactive fastening clips at distal ends of each strap. Two sheets of fabric are adhered by adhesive moulding to opposite sides of the bra core, each layer of fabric being of a continuous sheet, molded to the contour of the bra core.

Preferably each sheet of fabric is co-extensive with the bra core.

Preferably the second sheet of foam material is apiece of skived foam cut to a predefined cup shape.

Preferably the first sheet of molded foam material is an open cell foam formed from a sheet of foam material of 1 mm to 5 mm thick.

Preferably the rigid elongated member is made of a metal.

Preferably the rigid elongated member is made of a plastic.

Preferably the casing is of a fabric material.

Preferably the casing is adhered to each of the facing surfaces of the first and second sheets of foam material by an adhesive.

Preferably the casing is a tubular sock within which the rigid elongated member is located, the sock having closed distal ends.

Preferably the first sheet of molded foam material of each cup has been generated out of a single sheet of foam material.

Preferably the bra core is ultrasonically welded at its perimeter.

According to a further aspect of the present invention, there is provided a method of manufacturing a brassiere comprising the steps of preforming breast cups, each breast cup optionally including an underwire structure comprising a rigid elongated member and a casing about at least part of said rigid elongated member, affixing the breast cups to a chest band core comprising straps which are sewn to an inner gore, and which extend in opposite directions from the inner gore, to define a bra core, sandwiching the bra core between two sheets of fabric, adhering the two sheets of fabric to the bra core, affixing shoulder straps to each breast cup and affixing back clasps to the end of each straps.

Preferably adhesion of shoulder straps and the back clasps is achieved by ultrasonic welding.

In a further aspect the present invention consist in a brassiere of a kind made according to the method as hereinbefore defined.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. For the purposes of illustrating the invention, there is shown in the drawings a form which is presently preferred. It is being understood however that this invention is not limited to the precise arrangements shown.

BRIEF DESCRIPTION OF THE DRAWINGS

A preferred embodiment of the present invention will now be described with reference to the accompanying figures.

DETAILED DESCRIPTION OF THE INVENTION

Breast Cup Construction

The breast cup construction of the present invention is defined by at least a first and second layer of foam material which have each been formed to a three dimensional cup shape. The first and second layer of foam material are adhered to each other and may include an intermediate underwire assembly. The breast cup construction will have a concave side and a convex side. The concave side is that side which will be proximate most to the skin of a person wearing the bra which incorporates the breast cup construction. In the most preferred form, the foam sheet material which is provided on the concave side of the breast cup construction is made from a flat (substantially uniform thickness) piece of foam. The foam that is used for this layer is preferably a urethane foam and of a thickness of approximately 1 mm to 5 mm.

The second layer of foam of the breast cup construction is located on the convex side and is preferably provided from apiece of skived foam which has preferably been cut from a block of foam material. The second sheet of foam may alternatively also be made from a flat sheet, but there is advantage to the provision of a skived foam piece, in that it already has its three dimensional form defined prior to it being engaged to the foam made from the flat sheet defining the first sheet of the core.

Figure 3:
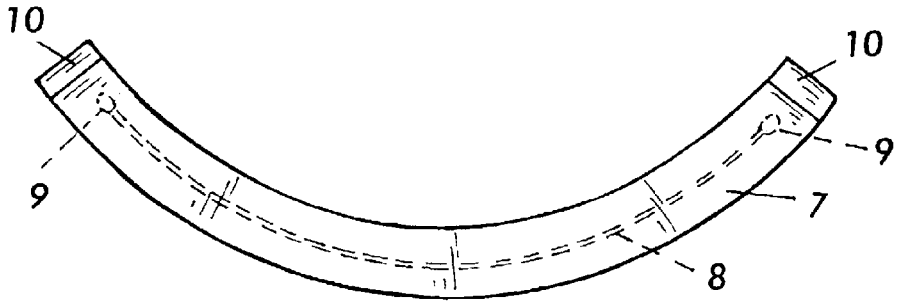
FIG. 3 illustrates an underwire assembly.
Figure 4:
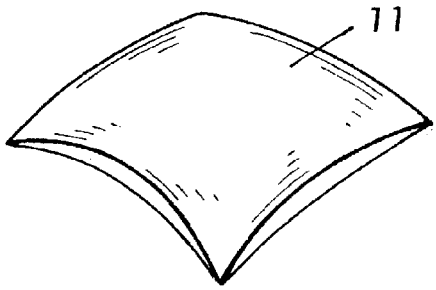
FIG. 4 is a perspective view of a skived panel of foam material to provide a second component to the core of a breast construction.
Figure 5:
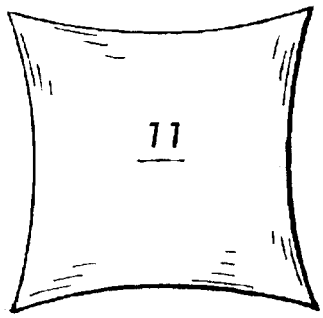
FIG. 5 is a plan view of FIG. 4.
Figure 6:
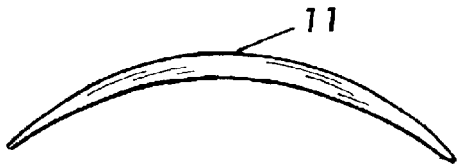
FIG. 6 is a side view of FIG. 4.
Figure 7:
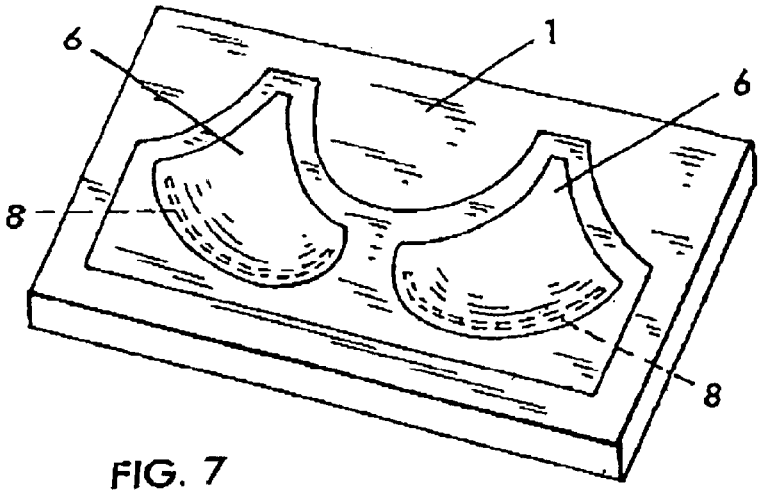
FIG. 7 is a perspective view of the mold half of FIG. 1 but on which the shaped foam sheet of one of the layers of the core is supported and on top of each cup shape, there is provided the underwire assembly of FIG. 3.
Figure 8:
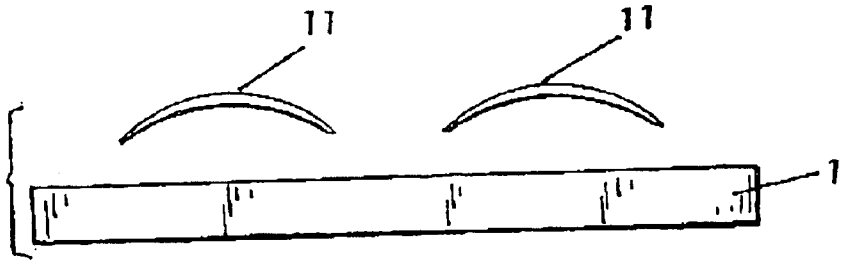
FIG. 8 shows the same mold half in a side view and wherein the skived foam pieces of FIGS. 4–6 are positioned ready for placement on top of the foam sheet which has previously been formed into the two cup shapes.

Should the breast cup construction be utilised for the manufacture of an underwire bra, then an underwire assembly as shown in FIG. 3 can be provided intermediate of the two foam sheets.

The underwire assembly consists of a wire casing 7 which encloses a wire 8. The wire casing is preferably made from a fabric material such as polyester based cotton, LYCRA, (spandex) or nylon and is effectively a sock into which the wire can be pushed. The wire 8 has at its distal end features which prevent or reduce the possibility of the wire pushing through the fabric material of the casing such as a dome 9. The wire may alternatively be bent or formed at the ends to provide a less sharp distal end. The casing has sealed ends and some clearance may be provided between the distal ends of the wire and the sealed ends of the casing to provide the wire with some room for movement within the casing without piercing the casing.

Figure 1:
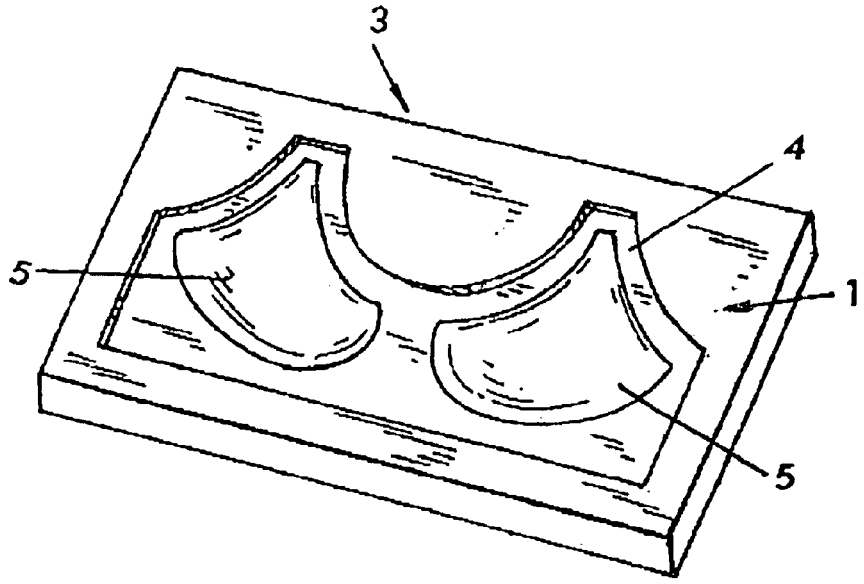
FIG. 1 is a perspective view of one half (bottom half) of a mold for the manufacture of the breast cup and/or the bra of the present invention.
Figure 2:
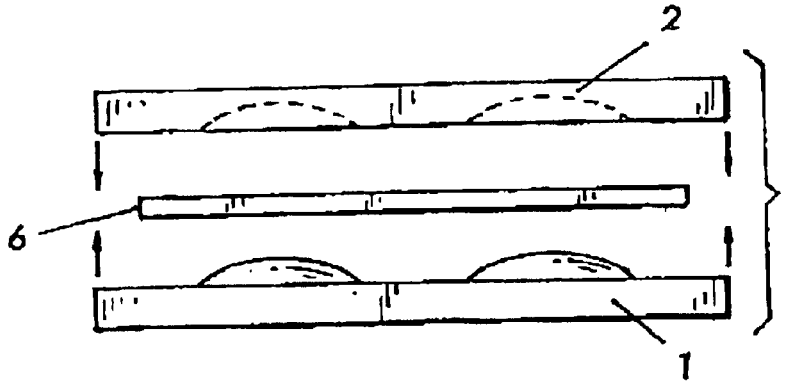
FIG. 2 is a side view illustrating two mold halves and an intermediate foam sheet ready to be pressed between the mold halves for the forming of the foam sheet to define two core components for two mirror image breast cups.

The manufacture of the breast cup construction is such that no stitching is required to be used. A mold half 1 as shown in FIG. 1 which includes two mirror image breast cup reliefs 5 and a perimeter region 4 is taken, onto which the first sheet of substantially uniform thickness foam 6 is placed. A second mold half 2 which includes substantially complimentary relief surfaces to the relief surfaces 5 and perimeter region 4 of the first mold half will be brought into contact with the foam sheet 6 to thereby press the foam sheet 6 with the first mold half 1 to define cup shapes in the foam sheet 6. With the application of heat a permanent deformation of the foam sheet 6 can be provided. The foam sheet 6 is preferably subjected to a temperature of approximately 200° C.–210° C. for a duration of 150 seconds by one or both of the mold halves 1, 2 whilst placed together, whereafter the mold halves will be separated and one of the major surfaces of the then formed foam sheet 6 will be exposed. The foam sheet 6 may remain within this the first mold half 1, after forming. Placed on top of each of the cup shapes formed in the sheet 6 are second sheets of foam 11. Such second sheets of foam 11 are of a size which is substantially the same or larger than the cup shapes defined in the sheet 6. The second sheets are placed onto the convex side of the formed sheet 6. The second sheets 11 are preferably of a pre-shaped form and are preferably pieces of skived foam which have been cut from a block of material in a predetermined three dimensional curvature. The second sheets of foam may alternatively be made from a planar sheet of foam and formed either prior to or during its engagement with the first sheet of foam 6.

The skived foam 11, placed onto the formed sheet 6 is then subjected by the second mold half to a pressing with the first sheet. Again a temperature of approximately 200° C.–210° C. and dwell time of 150 seconds subjected to both sheets to thereby fuse both sheets together. Should it be desired that the breast cup construction also includes an underwire, then an underwire assembly as shown in FIG. 3 can be included intermediate of the first sheet 6 and second (s) 11, prior to the placement of the second sheet. The underwire assembly of FIG. 3 is for example placed onto the formed sheet 6 after it is formed to its three dimensional shape. The underwire assembly may for example be adhered to the first sheet 6 by adhesion using for example an adhesive material. One side of the wire casing may be sprayed with glue for adhesion onto the layer 6 the other side may be sprayed with a glue for adhesion onto a surface of the sheets 11. Once the second sheet(s) are placed on top of the first sheet 6, the underwire assembly becomes trapped between the two sheets. The underwire assembly is placed in an appropriate location such as towards the bottom curvature of the cup construction.

Figure 9:
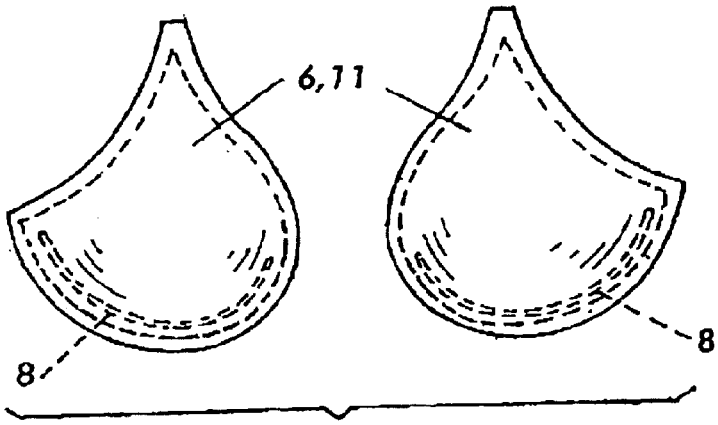
FIG. 9 illustrates two mirror image cup shaped cores of the breast cup construction and showing in phantom the underwire assembly of each.

Once the two cup constructions are formed by the sheet 6 and sheet(s) 11 being adhered together with or without an underwire assembly intermediate thereof, the molding is removed from the mold halves and trimmed to define the breast cup constructions as shown in FIG. 9. These are formed by the trimming of the material removed from mold and by preferably leaving a margin of approximately 5–6 mm around the three dimensional cup contour of the cup.

Whilst in the preferred form, each complimentary cup shape (left and right cup) are formed from one molding, alternatively separate molds may be used for molding each of the left and right cups.

The skived foam that may be used, preferably varies in thickness which decreases towards the edges.

When the two mold halves are brought together, a slight gap remains between the three dimensional molding surfaces which define the cup mold shape so the material of the first and second sheets 6, 11 is at least in the middle of the cup shape not completely pressed together. The gap between the first and second mold halves at the cup shape regions, does vary.

In an alternative to the above formation may include the skived foam layer being on the concave side of the cup form.

Bra Construction

Figure 10:
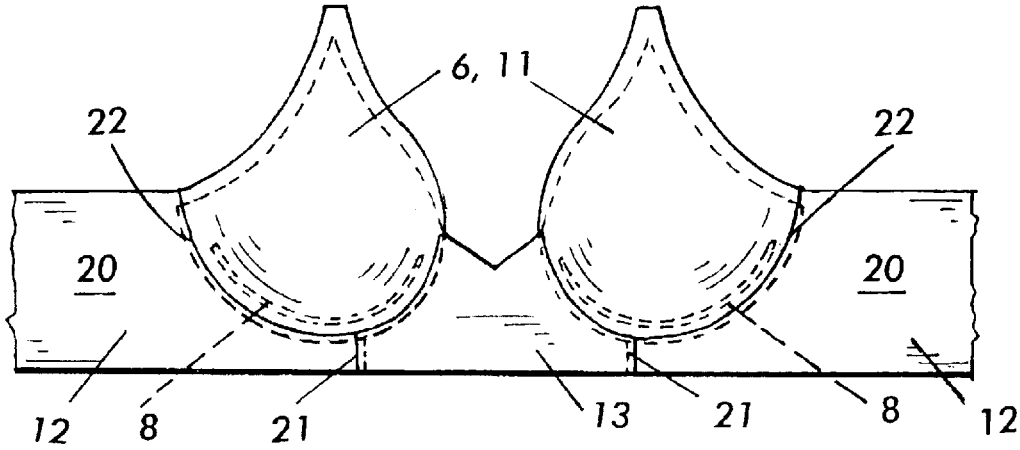
FIG. 10 illustrates each breast cup construction engaged to a chest band.
Figure 11:
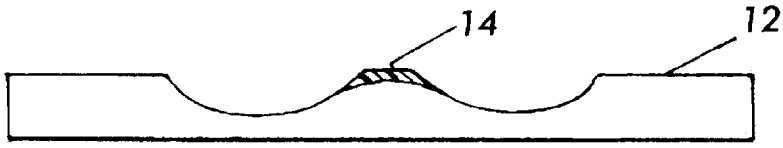
FIG. 11 illustrates a plan view of a chest band.

The breast cup constructions as hereinbefore described can be utilised in an overall bra construction. Referring to FIGS. 10 and 11, the most preferred form the bra is manufactured by engaging two breast cups to a chest band core 12. The chest band core 12 is engaged to the cups by stitching along part of the perimeter of each cup. The core itself consists of strap regions 20 which are sewn onto the inner gore 13 at stitch lines 21. This is then sewn to the breast cup constructions along seams 22. With the breast cup construction and the chest band core engaged together, a bra core is defined.

With reference to FIG. 11, there is shown a region 14 which is a foam region. This region 14 serves to provide support and stiffness to the finished bra at the region between the two breast cups.

Figure 12:
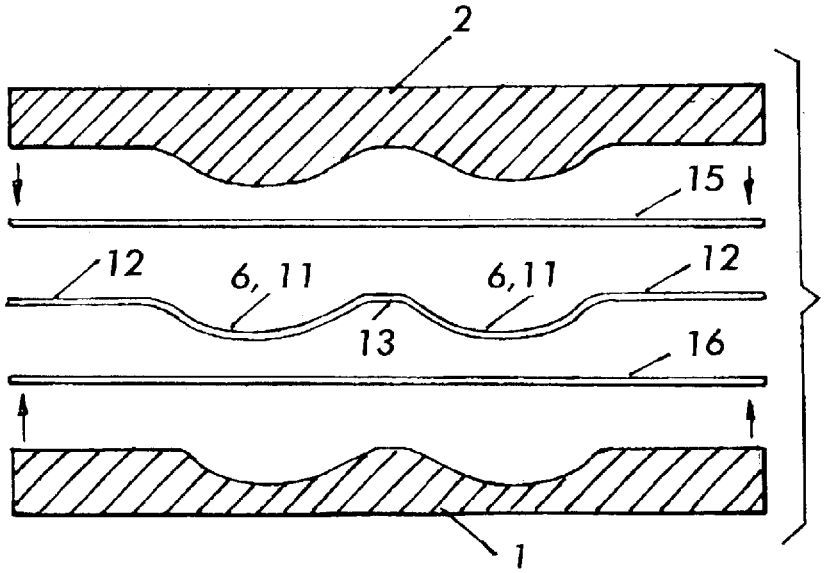
FIG. 12 illustrates the two mold halves ready for pressing the bra core as shown in FIG. 10 with two sheets of fabric to sandwich the bra core.

The bra core consisting of the foam breast cup construction hereinbefore described is engaged to the chest band core 12, and is then placed into a molding arrangement as shown in FIG. 12. A first layer of fabric material 16 is placed onto the lower mold half 1. This fabric material 16 is of a size larger than the size of the bra core so as to completely overlie the bra core. The bra core is then placed onto the fabric material 16 and a second layer of outer fabric material 15 is placed onto the bra core. The second outer layer 15 is also of a size larger than the perimeter size of the bra core. The upper mold half 2 is then brought into engagement to press the layers of the outer fabric 15, 16 and the bra core together. The outer fabric layers 15 and 16 will be deformed to follow the contours of the cup shapes and with a dwell time of 150 seconds and a heating temperature of between 200° C.–210° C., the outer fabric sheets 15, 16 become adhered to the bra core both at the breast cup constructions and at the chest band core. The sheets of fabric material 15, 16 are substantially each made of a single sheet of material and by the fact that each outer layer overlies the bra core, no seams will be visible to a person once the outer layers, 15, 16 have been engaged.

Figure 13:
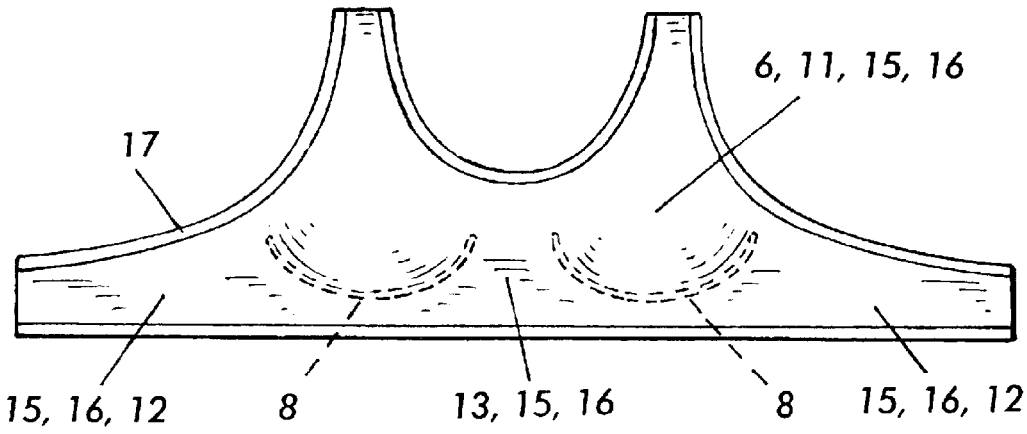
FIG. 13 illustrates a pressed bra after being removed from the mold halves having the sandwiching fabric engaged onto the bra core but prior to a perimeter trimming and sealing.
Figure 14:
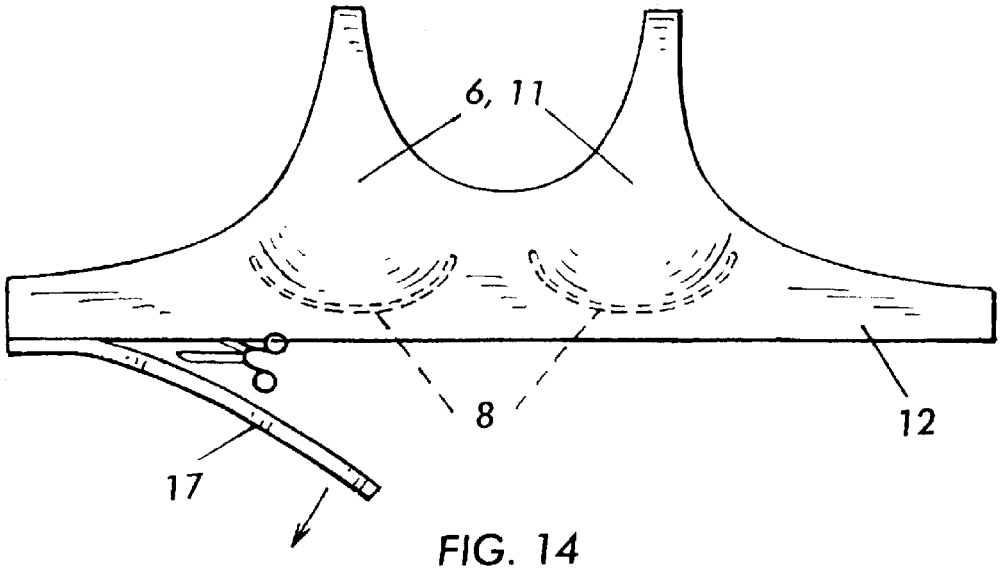
FIG. 14 illustrates a perimeter trimmed bra of the present invention.

The molding is then removed from the mold halves and the resultant bra precursor as shown in FIG. 13 exists. A perimeter margin 17 formed at regions of the bra precursor as shown in FIG. 13 by the two mold halves 1, 2 being substantially engaged together in then molding condition, then needs to be trimmed. This trimming is achieved for example by a cutting device. The removal of the margin may alternatively be achieved by a combined ultrasonic cutting and fusing step. The ultrasonic cutting and fusing step will remove the margin from the bra and simultaneously seal the perimeter of the bra to prevent any fraying of material. The ultrasonic fusing an cutting can be achieved by an ultrasonic bonding machine (such as a sonobond machine) set to a 3 mm setting. The molded bra is placed into a fusing horn for fusing and cutting the final shape. Thereafter straps and hook pads can be added to the fused and cut bra by either an ultrasonic bonding or by stitching.

The bra of the present invention can be made substantially at least without any visible stitching. The bra is much more durable and eliminates problems caused by repeated washing and wearing which can cause the seams of the stitching to become undone or fray. The use of the bra cup construction comprising of the at least two sheets of foam material makes the shape of the bra more sustainable after washing.

The durability of the bra and the lack of stitching means that skin allergies/abrasions from wires which would have penetrated through the bra, and or loose stitching can be avoided. Because of the sandwiching nature of the bra construction, little or no undesirable deformation of the bra occurs. The positioning of the wire assembly between the cups ensures that they are much more secured and its position is much more controlled and thereby prevents sliding. This leads to stronger support and more conformed fitting of the bra against the body. With the lack of stitching across the breast cup construction, it means the contour lines of the bra are much less visible and the breast curve can be well concealed.

The present invention may be embodied in other specific forms without departing from the spirit or essential attributes thereof and accordingly reference should be made to the appended claims rather than the foregoing specification as indicating the scope of the invention.

What is claimed is:

1. A brassiere comprising;

a bra core and two layers of fabric respectively adhered by adhesive molding to opposite sides of the bra core, each layer of fabric being comprised of a continuous sheet molded to the contour of the bra core; wherein the bra core includes:

two molded flexible breast cup assemblies, each breast cup assembly being comprising of at least a first sheet of molded foam material and a second coextensive sheet of foam material laminated directly to the first sheet, and a chest band core comprised of straps sewn onto an inner gore region by stitching and extending in opposite directions from the inner gore region sufficient distance to extend around the chest of a wearer, with each breast cup affixed by stitching to the chest band core and with connectable fastening clips at distal ends of each the strap.

2. A brassiere as claimed in claim 1, wherein each sheet of fabric is co-extensive with the bra core.

3. A brassiere as claimed in claim 1, wherein the second sheet of foam material is a piece of skived foam cut to a predefined cup shape.

4. A brassiere as claimed in claim 1, wherein the first sheet of molded foam material is an open cell foam formed from a sheet of foam material having a thickness of between about 1 mm and about 5 mm.

5. A brassiere as claimed in claim 1, further including a first and a second underwire structure sandwiched intermediate the first and second foam sheets, which are respectively located adjacent to one of the breast cups, the underwire structures each being comprised of a rigid elongated member and a casing surrounding the rigid elongated member.

6. A brassiere as claimed in claim 5, wherein the rigid elongated members are formed of a metal.

7. A brassiere as claimed in claim 5, wherein the rigid elongated members are formed of plastic.

8. A brassiere as claimed in claim 5, wherein the casings are formed of a fabric material.

9. A brassiere as claimed in claim 5, wherein the casings are adhered to the opposed surfaces of the first and second sheet of foam material by an adhesive.

10. A brassiere as claimed in claim 5, wherein the casings are a tubular socks within which the rigid elongated members are located, the socks having closed distal ends.

11. A brassiere as claimed in claim 1, wherein the first sheet of molded foam material of each cup is formed from a single sheet of foam material.

12. A brassiere as claimed in claim 1, wherein the bra core is ultrasonically welded at its perimeter.

13. A method of manufacturing a brassiere comprising the steps of: preforming two molded flexible breast cup assemblies by laminating at least a first sheet of molded foam material and a second coextensive sheet of foam material directly to each other; affixing the breast cups to a chest band core comprised of back straps which are sewn to an inner gore, and which extend in opposite directions from the inner gore to define a bra core, sandwiching the bra core between two sheets of fabric; adhering the two sheets of fabric to the bra core; affixing shoulder straps to each breast cup; and affixing back clasps to end of each the back straps.

14. A method as claimed in claim 13, wherein the shoulder straps and back clasps are affixed by ultrasonic welding.

15. A method as claimed in claim 13, wherein the step of preforming the breast cups includes the step of sandwiching an underwire structure comprising a rigid elongated member and a casing surrounding at least part of the rigid elongated member, between the sheets of the foam material.

* * * * *